US008431320B2

(12) United States Patent
Matsubara et al.

(10) Patent No.: US 8,431,320 B2
(45) Date of Patent: Apr. 30, 2013

(54) TONER MANUFACTURING METHOD

(75) Inventors: Masaharu Matsubara, Tokyo (JP); Hiroyuki Kozuru, Tokyo (JP); Noboru Ueda, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 153 days.

(21) Appl. No.: 13/187,012

(22) Filed: Jul. 20, 2011

(65) Prior Publication Data

US 2012/0021352 A1 Jan. 26, 2012

(30) Foreign Application Priority Data

Jul. 22, 2010 (JP) ..... 2010-164758

(51) Int. Cl.
*G03G 9/087* (2006.01)

(52) U.S. Cl.
USPC ..... 430/137.14; 430/109.1; 430/109.3; 430/109.4

(58) Field of Classification Search ..... 430/137.14, 430/109.1, 109.3, 109.4
See application file for complete search history.

(56) References Cited

U.S. PATENT DOCUMENTS

2008/0124635 A1* 5/2008 Nakamura et al. ..... 430/48
2009/0196658 A1* 8/2009 Sugiura ..... 399/252

FOREIGN PATENT DOCUMENTS

JP 05-088403 4/1993
JP 2009-151005 7/2009
JP 2009-197069 9/2009

* cited by examiner

*Primary Examiner* — Hoa V Le
(74) *Attorney, Agent, or Firm* — Lucas & Mercanti, LLP

(57) ABSTRACT

Disclosed is a manufacturing method of toner which includes at least polyester resin and colorant, comprising the steps of: (A) dissolving, into an organic solvent, the polyester resin and ultrahigh molecular weight styrene resin in which a peak is present in a range larger than 500 thousands and smaller than 3 million in a molecular weight distribution, and preparing a binder resin solution; (B) dispersing the binder resin solution as binder resin solution droplets into an aqueous medium; (C) removing the organic solvent from the binder resin solution droplets, and preparing a resin particle dispersion; and (D) aggregating resin particles from which the organic solvent is removed and colorant particles containing the colorant with each other, and forming toner particles.

11 Claims, 1 Drawing Sheet

| TONER | EXAMPLE | RESIN FINE PARTICLE DISPERSION | RESIN FINE PARTICLE D50 nm | RESIN FINE PARTICLE Mw | RESIN FINE PARTICLE Mn | BLEND RATIO | ULTRAHIGH MOLECULAR WEIGHT COMPONENT Mp | ULTRAHIGH MOLECULAR WEIGHT COMPONENT AREA RATIO % | OCCURRENCE OF HIGH-TEMPERATURE OFFSET ℃ | IMAGE QUALITY | SEPARATION PROPERTY |
|---|---|---|---|---|---|---|---|---|---|---|---|
| TONER 1 | EXAMPLE 1 | A | 210 | 520THOUSANDS | 13 THOUSANDS | 10 | 1.31 MILLION | 4.1 | NOT OCCURRED | ◎ | ◎ |
| TONER 2 | EXAMPLE 2 | SAMPLE(1) | - | - | - | 10 | 1.30 MILLION | 4 | NOT OCCURRED | ○ | ○ |
| TONER 3 | EXAMPLE 3 | B | 215 | 470THOUSANDS | 12 THOUSANDS | 10 | 0.9 MILLION | 3.2 | 190 | ○ | ○ |
| TONER 4 | EXAMPLE 4 | C | 205 | 550THOUSANDS | 14 THOUSANDS | 10 | 2.50 MILLION | 4.9 | NOT OCCURRED | ○ | ◎ |
| TONER 5 | EXAMPLE 5 | D | 220 | 520THOUSANDS | 12 THOUSANDS | 10 | 1.10 MILLION | 3.7 | 200 | ○ | ◎ |
| TONER 6 | EXAMPLE 6 | A | 210 | 520THOUSANDS | 13 THOUSANDS | 25 | 1.31 MILLION | 4.1 | NOT OCCURRED | ○ | ◎ |
| TONER 7 | EXAMPLE 7 | A | 210 | 520THOUSANDS | 13 THOUSANDS | 2 | 1.31 MILLION | 4.1 | 190 | ○ | ○ |
| TONER 8 | EXAMPLE 8 | A | 205 | 520THOUSANDS | 13 THOUSANDS | 10 | 1.31 MILLION | 4.1 | NOT OCCURRED | ◎ | ○ |
| TONER 9 | COMPARATIVE EXAMPLE 1 | SAMPLE(2) | - | 630THOUSANDS | 16 THOUSANDS | 10 | 6.80 MILLION | 5.2 | NOT OCCURRED | × | ○ |
| TONER 10 | COMPARATIVE EXAMPLE 2 | NONE | 180 | 22 THOUSANDS | 9 THOUSANDS | 10 | - | 0 | 160 | ◎ | × |
| TONER 11 | COMPARATIVE EXAMPLE 3 | E | 205 | 400THOUSANDS | 12 THOUSANDS | 10 | 0.45 MILLION | 2.7 | 180 | ◎ | × |
| TONER 12 | EXAMPLE 9 | A | 210 | 520THOUSANDS | 13 THOUSANDS | 10 | 1.31 MILLION | 4.1 | 200 | ○ | ○ |

| TONER | EXAMPLE | RESIN FINE PARTICLE DISPERSION | RESIN FINE PARTICLE D50 nm | RESIN FINE PARTICLE Mw | RESIN FINE PARTICLE Mn | BLEND RATIO | ULTRAHIGH MOLECULAR WEIGHT COMPONENT Mp | ULTRAHIGH MOLECULAR WEIGHT COMPONENT AREA RATIO % | OCCURRENCE OF HIGH-TEMPERATURE OFFSET ℃ | IMAGE QUALITY | SEPARATION PROPERTY |
|---|---|---|---|---|---|---|---|---|---|---|---|
| TONER 1 | EXAMPLE 1 | A | 210 | 520THOUSANDS | 13 THOUSANDS | 10 | 1.31 MILLION | 4.1 | NOT OCCURRED | ◎ | ◎ |
| TONER 2 | EXAMPLE 2 | SAMPLE(1) | - | - | - | 10 | 1.30 MILLION | 4 | NOT OCCURRED | ○ | ○ |
| TONER 3 | EXAMPLE 3 | B | 215 | 470THOUSANDS | 12 THOUSANDS | 10 | 0.9 MILLION | 3.2 | 190 | ○ | ○ |
| TONER 4 | EXAMPLE 4 | C | 205 | 550THOUSANDS | 14 THOUSANDS | 10 | 2.50 MILLION | 4.9 | NOT OCCURRED | ○ | ◎ |
| TONER 5 | EXAMPLE 5 | D | 220 | 520THOUSANDS | 12 THOUSANDS | 10 | 1.10 MILLION | 3.7 | 200 | ○ | ◎ |
| TONER 6 | EXAMPLE 6 | A | 210 | 520THOUSANDS | 13 THOUSANDS | 25 | 1.31 MILLION | 4.1 | NOT OCCURRED | ○ | ◎ |
| TONER 7 | EXAMPLE 7 | A | 210 | 520THOUSANDS | 13 THOUSANDS | 2 | 1.31 MILLION | 4.1 | 190 | ○ | ○ |
| TONER 8 | EXAMPLE 8 | A | 205 | 520THOUSANDS | 13 THOUSANDS | 10 | 1.31 MILLION | 4.1 | NOT OCCURRED | ◎ | ○ |
| TONER 9 | COMPARATIVE EXAMPLE 1 | SAMPLE(2) | - | 630THOUSANDS | 16 THOUSANDS | 10 | 6.80 MILLION | 5.2 | NOT OCCURRED | × | ○ |
| TONER 10 | COMPARATIVE EXAMPLE 2 | NONE | 180 | 22 THOUSANDS | 9 THOUSANDS | 10 | - | 0 | 160 | ◎ | × |
| TONER 11 | COMPARATIVE EXAMPLE 3 | E | 205 | 400THOUSANDS | 12 THOUSANDS | 10 | 0.45 MILLION | 2.7 | 180 | ◎ | × |
| TONER 12 | EXAMPLE 9 | A | 210 | 520THOUSANDS | 13 THOUSANDS | 10 | 1.31 MILLION | 4.1 | 200 | ○ | ○ |

TONER MANUFACTURING METHOD

CROSS-REFERENCE TO RELATED APPLICATION

The present U.S. patent application claims a priority under the Paris Convention of Japanese patent application No. 2010-164758 filed on Jul. 22, 2010, which shall be a basis of correction of an incorrect translation, and is incorporated by reference herein.

BACKGROUND OF THE INVENTION

1. Field of the Invention

The present invention relates to a toner manufacturing method.

2. Description of Related Art

Heretofore, in order to obtain printed matter with high image quality by giving a high gloss thereto without causing an offset phenomenon and the like at a fixing time, it is known to be effective to use polyester resin as binder resin that composes toner particles (for example, refer to Japanese Patent Laid-Open Publication. Nos. H05-88403 and 2009-151005).

Japanese Patent Laid-Open Publication No. H05-88403 discloses pulverized toner, in which productivity is accordingly too low to achieve a diameter reduction for the purpose of enhancing image quality. Moreover, though being mixed with each other, the polyester resin and vinyl polymer are not fused with each other at a molecular level, and accordingly, offset resistance of the pulverized toner is insufficient.

Meanwhile, Japanese Patent Laid-Open Publication No. 2009-151005 discloses polymerized toner, and accordingly, a diameter reduction thereof is easy. However, since added silica is not an elastic body, fixing/separating properties of the polymerized toner are insufficient.

Moreover, there is known a technology for obtaining toner in such a manner that mixed matter is added to an aqueous phase, and emulsified urethane molecules are stretched and aggregated (for example, refer to Japanese Patent Laid-Open Publication No. 2009-197069).

However, the toner in Japanese Patent Laid-Open Publication No. 2009-197069 has a problem that cost at the time of producing the same is increased since an operation therefor is divided into multiple stages and becomes complicated.

SUMMARY OF THE INVENTION

The present invention has been made in consideration of the above-described circumstances. It is an object of the present invention to provide a manufacturing method of toner which is excellent in image quality, is sufficient in low-temperature fixing property and offset resistance, that is, in fixing-enabled temperature range, moreover, can be obtained by a simple operation, and is advantageous also in terms of cost.

To achieve at least one of the abovementioned objects, a manufacturing method of toner which includes at least polyester resin and colorant, reflecting one aspect of the present invention comprises the steps of:

(A) dissolving, into an organic solvent, the polyester resin and ultrahigh molecular weight styrene resin in which a peak is present in a range larger than 500 thousands and smaller than 3 million in a molecular weight distribution, and preparing a binder resin solution;

(B) dispersing the binder resin solution as binder resin solution droplets into an aqueous medium;

(C) removing the organic solvent from the binder resin solution droplets, and preparing a resin particle dispersion; and (D) aggregating resin particles from which the organic solvent is removed and colorant particles containing the colorant with each other, and forming toner particles.

BRIEF DESCRIPTION OF THE DRAWINGS

The present invention will become more fully understood from the detailed description given hereinbelow and the appended drawings, and thus are not intended as a definition of the limits of the present invention, wherein;

[FIG. 1 shows] Table 1 reports the results from the Examples.

DESCRIPTION OF THE PREFERRED EMBODIMENTS

A description is made below of an example of a manufacturing method of toner according to the present invention.

[Manufacturing Method of Toner]

First, preferably, the following preparatory processes (1) to (5) are performed.

(1) Preparation Process of Ultrahigh Molecular Weight Styrene Resin

For ultrahigh molecular weight styrene resin of the present invention, emulsion polymerization is preferable since insoluble matter is not generated in a polyester resin solution.

(1-1) First-Stage Polymerization

As a monomer component that composes first-stage polymerization, there are mentioned a vinyl aromatic monomer, a vinyl ester monomer, a vinyl ether monomer, an olefin monomer, and the like. Among them, preferably, a divalent carboxylic acid that is radical polymerizable (hereinafter, also referred to as "radical polymerizable divalent carboxylic acid") component is contained as the monomer component.

A reason for this is as follows. Since a carboxyl radical as a polar radical is present, polymerization for obtaining resin fine particles in an aqueous medium can be stably progressed, and in addition, by using the divalent carboxylic acid, unreacted carboxylic acid becomes more likely to be oriented to a surface layer of a surface of each of the resin fine particles, and a polymer becomes more likely to be generated.

As the radical polymerizable divalent carboxylic acid, for example, (anhydrous) maleic acid, fumaric acid, itaconic acid, citraconic acid and the like are mentioned, and the itaconic acid is particularly preferable.

Moreover, a content ratio of the radical polymerizable divalent carboxylic acid in the whole of the monomer that should form a vinyl copolymer is preferably 3 to 20 mass %, more preferably 5 to 10 mass %.

As the vinyl ester monomer, for example, vinyl acetate, vinyl lactate, vinyl propionate, vinyl benzoate and the like are mentioned, and as the vinyl ether monomer, there can be mentioned vinyl methyl ether, vinyl ethyl ether, vinyl isobutyl ether, vinyl phenyl ether and the like.

As the olefin monomer, there can be mentioned: a monoolefin monomer such as ethylene, propylene, isobutylene, 1-butene, 1-pentene and 4-methyl-1-pentene; and a diolefin monomer such as butadiene, isoprene and chloroprene.

As other radial polymerizable monomers than those described above, there can be mentioned: an acrylic acid ester monomer such as ethyl acrylate, butyl acrylate and 2-ethylhexyl acrylate; a methacrylic acid ester monomer such as methyl methacrylate, ethyl methacrylate and butyl methacrylate; N-alkyl substituted acrylamide such as N-methyl acrylamide and N-ethyl acrylamide; a nitrile monomer such as acrylonitrile and methacrylonitrile; divinylbenzene; ethylene glycol (metha)acrylate; trimethylol propane tri(metha)acrylate; and the like.

Among them, the methyl methacrylate having a fast copolymerization rate is contained preferably by 65 to 80 mass %, more preferably by 75 to 80 mass %.

Moreover, for example, as a monomer component that should form a vinyl copolymer A, a crosslinking vinyl monomer having two or more unsaturated bonds may be further contained. As the vinyl monomer, there are mentioned divinylbenzene, divinyl naphthalene, divinyl ether, ethylene glycol dimethacrylate, polyethylene glycol dimethacrylate, and the like.

A mass-average molecular weight (Mw) of the first polymerization is 150000 to 600000, preferably 180000 to 220000. By adjusting the molecular weight of the first polymerization, a molecular weight and ratio of an ultrahigh molecular weight component in the resin fine particles in double-stage polymerization to be described later can be controlled.

The molecular weight of the resin is measured by gel permeation chromatography (GPC) as a measuring method. Specifically, a measurement sample is dissolved in tetrahydrofuran so that a concentration thereof can become 1 mg/ml. With regard to dissolution conditions, the measurement sample is dissolved at room temperature for 5 minutes by using an ultrasonic disperser. Subsequently, an obtained sample-dissolved solution is treated by a membrane filter with a pore size of 0.2 μm, and thereafter, 10 μL thereof is injected into the GPC. Specific examples of measurement conditions in the GPC are shown below.

Apparatus: HLC-8220 (made by Tosoh Corporation)
Column: TSK guard column+TSK gel Super HZM-M×3
Column temperature: 40° C.
Flow rate of tetrahydrofuran: 0.35 ml/min
Detector: refractive index detector (RI detector)

In measuring the molecular weight of the sample, a molecular weight distribution owned by the sample is calculated by using a calibration curve measured by using monodisperse polystyrene standard particles. As the polystyrene for the calibration curve measurement, 10 pieces having molecular weights of 7.5 million to 580 are used. The resin of the present invention is measured, and a weight-average molecular weight calculated by using this calibration curve is defined as Mw of the resin concerned, and a number-average molecular weight calculated thereby is defined as Mn of the resin. Moreover, a molecular weight that indicates a maximum peak height in a range where Mw is 300 thousands or more on an obtained chromatogram is obtained as a peak top molecular weight (Mp).

(1-2) Second-Stage Polymerization

As a monomer component that composes second-stage polymerization, monomers similar to those for the first-stage polymerization are mentioned. However, since a liquid monomer is advantageous in terms of operation, it is preferable that a component of a monovalent carboxylic acid that is radical polymerizable (hereinafter, also referred to as "radical polymerizable monovalent carboxylic acid") be contained as the monomer component.

As the radical polymerizable monovalent carboxylic acid, for example, methacrylic acid, acrylic acid and the like are mentioned. Moreover, a content ratio of the radical polymerizable monovalent carboxylic acid in the whole of the monomer that should form the second-stage polymerization is preferably 3 to 20 mass %, more preferably 5 to 10 mass %.

At the time of mixing the resin particle dispersion of the first-stage polymerization and the emulsion liquid of the monomer with each other in the second-stage polymerization, agitation intensity is weakened to approximately one-tenth of that defined in the standard, and the mixture is maintained for 5 to 30 minutes, whereby the ultrahigh molecular weight component can be generated.

It is preferable that, in the obtained GPC chart, such high molecular weight styrene resin has a peak in a range larger than 500 thousands and smaller than 3 million, preferably, larger than 1 million and smaller than 3 million from a viewpoint of preventing the hot offset and enhancing the fixing/separating properties without lowering the productivity. Moreover, if the high molecular weight styrene resin has a peak on a higher molecular weight side than this range, then a ratio of a high elastic component is increased. Accordingly, shape controllability is deteriorated at the time of forming toner, and the toner cannot be formed into a shape with desired circularity, causing an apprehension that a deterioration of the image quality may be brought about.

Moreover, from a viewpoint of solubility to the resin solution, in the ultrahigh molecular weight styrene resin fine particles, a particle diameter thereof is preferably 50 to 300 more preferably 60 to 250 for example, in terms of a median diameter in a volume basis.

(2) Colorant Dispersion Preparation Process

In this process, colorant can be prepared by being dispersed into an aqueous medium. Dispersion treatment of the colorant is performed in a state where a surfactant concentration is set at a critical micelle concentration (CMC) or more in water.

A disperser for use in the dispersion treatment of the colorant is not particularly limited; however, preferably, there are mentioned an ultrasonic disperser, a mechanical homogenizer, a pressure disperser such as Manton-Gaulin and a pressure homogenizer, and a medium-type disperser such as a sand grinder, a Getzmann mill and a diamond fine mill.

Note that colorant particles may be subjected to surface modification. In a surface modification method of the colorant, the colorant is dispersed in a solvent, a surface modification agent is added to a molecular weight solution concerned, and this system is reacted by raising temperature thereof. After the reaction is ended, the colorant is filtered, and is repeatedly cleaned and filtered by the same solvent, followed by drying, whereby colorant (pigment) treated by the surface modification agent is obtained.

(3) Releasing Agent Dispersion Preparation Process

This process is a process of dissolving or dispersing a releasing agent in the radical polymerizable monomer, thereby preparing a radical polymerizable monomer solution of the releasing agent concerned. For example, to an aqueous medium containing surfactant with a concentration equal to or less than the critical micelle concentration (CMC), there is added a solution of a monomer composition in which the releasing agent, a charge control agent and the like are contained according to needs, then mechanical energy is applied to a resultant to form liquid droplets, and subsequently, a water-soluble polymerization initiator is added thereto to progress a polymerization reaction in the liquid droplets concerned, whereby the radical polymerizable monomer solution of the releasing agent is obtained.

Note that an oil-soluble polymerization initiator may be contained in the liquid droplets. In such a polymerization treatment, a treatment of forcibly emulsifying the solution (forming liquid droplets) by applying mechanical energy is essential. As means for applying such mechanical energy, there can be mentioned means for applying strong agitation or ultrasonic vibration energy, such as a homo-mixer, ultrasonic waves, Manton-Gaulin, Clearmix, and Nanomizer. With regard to operation conditions when Clearmix is used, for example, the dispersion is performed at 18000 rpm at a temperature of 85° C.

(4) Crystalline Polyester Preparation Process

The polyester resin is synthesized from a multivalent carboxylic acid component and a multivalent alcohol component. Note that, in the present invention, as the polyester resin, a commercially available product may be used, or one obtained by appropriately synthesis may be used. A description is made below of the multivalent carboxylic acid component and the multivalent alcohol component, which are suitable for synthesizing the crystalline polyester resin.

As the multivalent carboxylic acid component, for example, there are mentioned: aliphatic dicarboxylic acid such as oxalic acid, succinic acid, glutaric acid, adipic acid, suberic acid, azelaic acid, sebacic acid, 1,9-nonane dicarboxylic acid, 1,10-decane dicarboxylic acid, 1,12-dodecane dicarboxylic acid, 1,14-tetradecane dicarboxylic acid and 1,18-octadecane dicarboxylic acid; aromatic dicarboxylic acid such as diprotic acid such as phthalic acid, terephthalic acid, naphthalene-2,6-dicarboxylic acid, malonic acid and mesaconic acid; and the like. Moreover, anhydrides of these and lower alkyl esters of these are also mentioned; however, the multivalent carboxylic acid component is not limited to these.

As trivalent or more carboxylic acid, for example, there are mentioned 1,2,3-benzene tricarboxylic acid, 1,2,4-benzene tricarboxylic acid, 1,3,5-benzene tricarboxylic acid, 1,2,4-naphthalene tricarboxylic acid and the like, anhydrides of these, lower alkyl esters of these and the like. These may be used singly, or two or more thereof may be used in combination. Moreover, besides the above-mentioned aliphatic dicarboxylic acid and aromatic dicarboxylic acid, more preferably, a dicarboxylic acid component having a double bond is contained.

The dicarboxylic acid having the double bond can radically make a crosslinking bond through the double bond, and accordingly, can be suitably used for the purpose preventing the hot offset at the fixing time. As the dicarboxylic acid as described above, for example, there are mentioned, maleic acid, fumaric acid, 3-hexene dioic acid, 3-octene dioic acid and the like; however, the dicarboxylic acid is not limited to these. Moreover, there are also mentioned lower esters of these, anhydrides of these and the like. Among them, fumaric acid, maleic acid and the like are mentioned in terms of cost.

As the multivalent alcohol component, aliphatic diol is preferable, and straight-chain aliphatic diol in which a carbon number of a principal chain portion is 7 or more to 20 or less is more preferable. If the above-described aliphatic diol is of a branch type, then crystallinity of the polyester resin is decreased, and a melting point thereof drops, and accordingly, a deterioration sometimes occurs in toner blocking resistance, image retention, and low-temperature fixing property. Moreover, if the carbon number is less than 7, in the case where the aliphatic diol is polycondensed with the aromatic dicarboxylic acid, then a melting point of a resultant becomes high, and low-temperature fixing thereof becomes sometimes difficult. Meanwhile, if the carbon number exceeds 20, then it becomes likely to be difficult to obtain the aliphatic diol as a practical material. More preferably, the above-described carbon number is 14 or less.

As the aliphatic diol for suitable use in synthesizing the crystalline polyester, specifically, for example, there are mentioned ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanedecanediol, and the like; however, the aliphatic dial is not limited to these. Among these, in consideration of ease of obtainment, 1,8-octanediol, 1,9-nonanediol and 1,10-decanediol are preferable.

As trivalent or more alcohol, for example, there are mentioned trimethylol ethane, trimethylol propane, pentaerythritol and the like. These may be used singly, or two or more thereof may be used in combination.

Among the multivalent alcohol components, a content of the aliphatic diol component is preferably 80 mol % or more, more preferably 90 mol % or more. If the content of the above-described aliphatic diol component is less than 80 mol %, then the crystallinity of the polyester resin is decreased, and the melting point thereof drops, and accordingly, the deterioration sometimes occurs in the toner blocking resistance, the image retention, and the low-temperature fixing property.

Note that, according to needs, for the purpose of adjusting an acid value and a hydroxyl value, and so on, monovalent acid such as acetic acid and benzoic acid and monovalent alcohol such as cyclohexanol and benzyl alcohol can also be used.

The "crystallinity" as in the crystalline polyester resin refers to that there is not a step-wise endothermic change but an obvious endothermic peak in differential scanning calorimetry. Specifically, the "crystallinity" stands for that a half width of the endothermic peak at the time when measurement therefor is performed at a temperature rise rate of 10° C./min is within 6° C. Meanwhile, resin in which the half width exceeds 6° C. and resin in which the obvious endothermic peak is not recognized stand for amorphous resin, and as amorphous resin for use in the present invention, it is preferable to use the resin in which the obvious endothermic peak is not recognized.

Moreover, the "crystalline polyester resin" as described above stands for not only a polymer in which a constituent component is composed of a polyester structure by 100% but also a polymer (copolymer) composed by polymerizing a component composing polyester and other components with each other. However, in the case of the latter one, the other constituent components than the polyester, which compose the polymer (copolymer), are contained by 50 mass % or less.

A manufacturing method of the crystalline polyester resin is not particularly limited. The crystalline polyester resin can be produced by a general polyester polymerization method of reacting an acid component and an alcohol component with each other. The crystalline polyester resin is produced, for example, by properly using direct polycondensation, an ester exchange method and the like depending on a type of the monomer. A molar ratio (acid component/alcohol component) at the time when the acid component and the alcohol component are reacted with each other cannot be uniquely determined since the molar ratio concerned differs depending also on reaction conditions and the like; however, is approximately 1/1 in usual. As a catalyst usable at the time of producing the crystalline polyester resin, there are mentioned: an alkaline metal compound of sodium, lithium or the like; an alkaline earth metal compound of magnesium, calcium or the like; a metal compound of zinc, manganese, antimony, titanium, tin, zirconium, germanium or the like; a phosphorous compound; a phosphate compound; an amine compound; and the like. Specifically, the following compounds are mentioned. For example, there are mentioned compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyl tin dichloride, dibutyl tin oxide, diphenyl tin oxide, zirconium tetrabutoxide, zirconium naphthenate, zirconyl carbonate, zirconyl acetate, zirconyl stearate, zirconyl octylate, germanium oxide, triphenyl phosphite, tris(2,4-t-butylphenyl) phosphite, ethyltriphenyl phosphonium bromide, triethyl amine, and triphenyl amine.

Note that, in this embodiment, for measurement of the melting point of the crystalline polyester resin, a differential scanning calorimeter (DSC) is used, and a top value of an endothermic peak at the time when measurement therefor is performed at a temperature rise rate of 10° C./min from room temperature (25° C.) to 150° C. is obtained.

The molecular weight is measured by the GPC, and a weight-average molecular weight (Mw) thereof is preferably 10000 or more to 35000 or less, more preferably 15000 or more to 30000 or less. If Mw is less than 10000, then it sometimes becomes difficult to ensure electric charge under high humidity, and meanwhile, if Mw is higher than 30000, then a gloss sometimes becomes difficult to appear at the time of performing the fixing at low temperature.

(5) Amorphous Polyester Preparation Process

As the amorphous polyester resin for use in this embodiment, publicly known polyester resin can be used. The amorphous polyester resin is synthesized from a multivalent carboxylic acid component and a multivalent alcohol component. Note that, as the above-described amorphous polyester resin, a commercially available product may be used, or a synthesized one may be used. Moreover, the amorphous polyester resin may be a single type of amorphous polyester resin, or may be a mixture of two or more types of polyester resin.

With regard to the multivalent alcohol component in the amorphous polyester resin, for example, as a divalent alcohol component, there can be used ethylene glycol, propylene glycol, 1,4-butanediol, 2,3-butanediol, diethylene glycol, triethylene glycol, 1,5-pentanediol, 1,6-hexanediol, neopentyl glycol, 1,4-cyclohexane dimethanol, dipropylene glycol, polyethylene glycol, polypropylene glycol, bisphenol A, hydrogen-added bisphenol A, and the like. Moreover, as a trivalent or more alcohol component, there are used glycerol, sorbitol, 1,4-sorbitan, trimethylol propane and the like. Moreover, as a divalent carboxylic acid component condensed with the above-described multivalent alcohol component, for example, there are mentioned: aromatic carboxylic acids such as terephthalic acid, isophthalic acid, anhydride trimellitic acid, pyromellitic acid, and naphthalene dicarboxylic acid; aliphatic saturated carboxylic acids such as succinic acid, alkenyl succinic acid, adipic acid, suberic acid, azelaic acid, sebacic acid, 1,9-nonane dicarboxylic acid, 1,10-decane dicarboxylic acid, 1,12-dodecane dicarboxylic acid, 1,14-tetradecane dicarboxylic acid, and 1,18-octadecane dicarboxylic acid; aliphatic unsaturated dicarboxylic acids such as maleic acid, anhydride maleic acid, fumaric acid, itaconic acid, anhydride itaconic acid, citraconic acid, anhydride citraconic acid, and mesaconic acid; alicyclic carboxylic acids such as cyclohexane dicarboxylic acid; and lower alkyl esters, acid anhydrides and the like of these acids. These are used singly, or two or more thereof are used in combination. Among these multivalent carboxylic acids, the aliphatic unsaturated dicarboxylic acids have a planar structure, and are desirable in terms of enhancing affinity with the crystalline polyester resin having high linearity. In particular, in the fumaric acid, the carboxylic acid is located at a trans position of the double bond, and accordingly, the linearity of the resin structure is enhanced more, and further, the affinity is enhanced. Therefore, the fumaric acid is suitable.

Moreover, in the alkenyl succinic acid or the anhydride thereof, an alkenyl radical having higher hydrophilicity in comparison with other functional radicals is present. In such a way, at the time of being used, the alkenyl succinic acid or the anhydride thereof can be made compatible with the crystalline polyester resin more easily. As examples of the alkenyl succinic acid component, there are mentioned n-dodecyl succinic acid, n-dodecenyl succinic acid, isododecyl succinic acid, isododecenyl succinic acid, n-octyl succinic acid, n-octenyl succinic acid, anhydrides of these, acid chlorides of these, and lower alkyl esters of these, in which a carbon number is 1 or more to 3 or less.

Moreover, the trivalent or more carboxylic acid is contained, whereby a polymer chain can take a crosslinking structure, and the offset resistance can be promoted. However, it is apprehended that the productivity may be decreased owing to generation of insoluble matter of the solvent. Therefore, preferably, the trivalent or more carboxylic monomer is set at 10 mass % of all the acid monomers for use in the amorphous polyester. From a viewpoint of enhancing the productivity, more preferably, linear polyester that does not contain trivalent or more carboxylic acid is used as the amorphous polyester, and the ultrahigh molecular weight styrene resin is made to be in charge of imparting elasticity at the time when the toner is fused.

As the above-described trivalent or more carboxylic acid, for example, there are mentioned: trimellitic acid such as 1,2,4-benzene tricarboxylic acid, 1,2,5-benzene tricarboxylic acid, and 1,3,5-benzene tricarboxylic acid; 1,2,4-naphthalene tricarboxylic acid; hemimellitic acid; trimesic acid; mellophanic acid; prehnitic acid: pyromellitic acid; mellitic acid; 1,2,3,4-butanetetracarboxylic acid; acid anhydrides of these; acid chlorides of these; and lower alkyl esters of these, in which a carbon number is 1 to 3. However, the trimellitic acid is particularly suitable. These may be used singly, or two or more thereof may be used in combination.

Moreover, as the acid component, preferably, a dicarboxylic acid component having a sulfonic acid radical is contained besides the above-mentioned aliphatic dicarboxylic acid and aromatic dicarboxylic acid. The dicarboxylic acid having the sulfonic acid radical is effective in being capable of favorably dispersing a coloring material such as pigment. Moreover, at the time of preparing a binder resin particle dispersion by emulsifying or suspending the whole of the resin in water, if the dicarboxylic acid component has the sulfonic acid radical, then it is also possible to emulsify or suspend the resin without using the surfactant as described later. From the above-described reason, in the amorphous polyester resin, desirably, a component is contained, in which at least one of the aliphatic unsaturated dicarboxylic acid and the anhydride thereof, at least one of the alkenyl succinic acid and the anhydride thereof, and at least one of the trimellitic acid and the anhydride thereof are contained and reacted with one another. Moreover, as mentioned above, with regard to an amount of the aliphatic unsaturated dicarboxylic acid in all the acid components, the amorphous polyester resin with a low molecular weight is set larger in amount in comparison with the amorphous polyester resin with a high molecular weight.

With regard to the molecular weight of the amorphous polyester resin, amorphous polyester resin can be suitably used, in which the weight-average molecular weight (Mw) ranges from 10000 to 150000. However, in order to obtain an image having a particularly high image gloss, more preferably, Mw ranges from 12000 to 60000, and a number-average molecular weight (Mn) of the amorphous polyester resin ranges from 3000 to 20000, still more preferably, Mw ranges from 13000 to 50000, and Mn ranges from 4000 to 15000. If Mw and Mn are too high, then chromogenic property is sometimes deteriorated, and if Mw and Mn are too low, then it becomes difficult to obtain image strength after the fixation, and it is apprehended that a high-temperature offset phenomenon may occur.

Moreover, with regard to a molecular weight distribution of the amorphous polyester resin, a value of Mw/Mn, which is an index of the molecular weight distribution, preferably ranges from 2 to 30. Furthermore, in the amorphous polyester resin for use in the toner of this embodiment, preferably, an acid value thereof is 5 mgKOH/g or more to 20 mgKOH/g or less. If the acid value is 5 mgKOH/g, then affinity of the toner with paper is good, and electrification characteristics thereof are also good. Moreover, in the case of producing the toner by emulsion aggregation to be described later, it is easy to fabricate emulsion particles, and furthermore, an aggregation rate in an aggregation process of the emulsion aggregation and a shape change rate in a coalescing process thereof can be suppressed from being significantly accelerated, and accordingly, it is easy to perform particle size control and shape control. Moreover, if the acid value of the amorphous polyester resin is 20 mgKOH/g or less, then environment dependency of the electrification is not adversely affected, and in addition, the aggregation rate in the aggregation process in the toner production by the emulsion aggregation and the shape change rate in the coalescing process thereof can be suppressed from significantly slowing down, and accordingly, the decrease of the productivity can be prevented.

Preferably, the acid value of the amorphous polyester resin is 6 mgKOH/g or more to 18 mgKOH/g or less.

A polymerization method here conforms to that in the case of the above-described crystalline polyester resin.

The toner is produced through the following processes (A) to (I) subsequently to the above-described preparatory processes.

(A) Binder Resin Solution Preparation Process

This process is a process of dissolving, in an organic solvent, the polyester resin and the ultrahigh molecular weight styrene resin fabricated in the above-described (1) process, thereby preparing a binder resin solution. The polyester resin for use at this time may be either of the crystalline polyester resin and the amorphous polyester resin. If the crystalline polyester resin is used, then preferably, the crystalline polyester resin is synthesized from the multivalent carboxylic acid component and the multivalent alcohol component. If the amorphous polyester resin is used, then publicly known polyester resin can be used, which is synthesized from the multivalent carboxylic acid component and the multivalent alcohol component. Specifically, the one prepared in the above-mentioned (5) preparatory process, which is the amorphous polyester preparation process, can be used.

Moreover, as the organic solvent for use in the above-described (A) process, for example, there can be illustrated: alcohols such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol, and cyclohexanol; ketones such as methylethylketone, methylisobutylketone, ethylbutylketone, cyclohexanone, and isophorone; ethers such as tetrahydrofuran, dimethyl ether, diethyl ether, and dioxane; esters such as methyl acetate, ethyl acetate, n-propyl acetate, isopropyl acetate, n-butyl acetate, isobutyl acetate, sec-butyl acetate, 3-methoxybutyl acetate, methyl propionate, ethyl propionate, butyl propionate, dimethyl oxalate, diethyl oxalate, dimethyl succinate, diethyl succinate, diethyl carbonate, and dimethyl carbonate; glycol derivatives such as ethylene glycol, ethylene glycol monomethyl ether, ethylene glycol monoethyl ether, ethylene glycol monopropyl ether, ethylene glycol monobutyl ether, ethylene glycol ethyl ether acetate, diethylene glycol, diethylene glycol monomethyl ether, diethylene glycol monoethyl ether, diethylene glycol monopropyl ether, diethylene glycol monobutyl ether, diethylene glycol ethyl ether acetate, propylene glycol, propylene glycol monomethyl ether, propylene glycol monopropyl ether, propylene glycol monobutyl ether, propylene glycol methyl ether acetate, and dipropylene glycol monobutyl ether; and further, 3-methoxy-3-methylbutanol; 3-methoxybutanol; acetonitrile; dimethylformamide; dimethylacetoamide; diacetone alcohol; ethyl acetoacetate; and the like. These solvents may be used singly, or two or more thereof may be used in combination. Particularly preferable solvents are ethyl acetate and methylethylketone from viewpoints of solubility and drying property.

At this time, a ratio of the ultrahigh molecular weight styrene resin in the binder resin of the toner is preferably 2% to 25%, more preferably 5% to 200, still more preferably 10% to 15%. If the ratio of the ultrahigh molecular weight styrene resin is less than 2%, then the elastic component of the toner becomes insufficient, and it becomes impossible to suppress the hot offset. Meanwhile, if the ratio exceeds 25%, then the shape controllability of the toner is deteriorated, and there occur a dropout of image quality, and the like.

Moreover, an area ratio of the ultrahigh molecular weight styrene resin is preferably 5% or less. This is because, if the area ratio exceeds 5%, then a softening point of the toner rises, causing an apprehension that the gloss and the fixing property may be decreased. The area ratio refers to a ratio occupied by a range, in which the molecular weight is equivalent to 500 thousands to 3 million, in a molecular weight distribution curve in conversion to styrene, which is obtained by measuring the resin by gel permeation chromatography (GPC).

(B) Resin Solution Dispersion Process

This process is a process of dispersing, into an aqueous medium, the above-described binder resin solution, which is obtained in the above-described (A) process, as binder resin solution liquid droplets.

As a dispersion method, an emulsification method using mechanical shearing force, a phase-transfer emulsification method and the like are mentioned.

In the case of directly emulsifying the binder resin solution, such emulsification is performed by applying the shearing force to a solution obtained by mixing the aqueous medium and a mixed solution (polymer liquid) containing unsaturated crystalline sulfonated polyester and the colorant according to the case. At this time, the solution thus obtained is heated, whereby viscosity of the polymer liquid can be decreased, and particles can be formed. Moreover, a dispersant can also be used for the purpose of stabilizing emulsified particles and preventing the increase of viscosity of the aqueous medium.

As an emulsifier for use in the above-described emulsification, for example, there are mentioned a homogenizer, a homo mixer, a pressure kneader, an extruder, a media disperser and the like.

With regard to a size of the emulsified liquid droplets (particles) of the above-described unsaturated crystalline polyester, an average particle diameter is preferably 0.01 to 1 μm, more preferably 0.03 to 0.3 μm. A heating temperature at the time of emulsification is selected depending on an emulsified state of the crystalline sulfonated polyester for use. When the emulsified state is poor, the temperature is raised. The emulsification can be performed in a range from the room temperature to 100° C.; however, preferably, the emulsification is performed in a range from 60° C. to 90° C.

As the disperser for use at the time of emulsification, for example, there are mentioned: a water-soluble polymer such as polyvinyl alcohol, methyl cellulose, ethyl cellulose, hydroxyethyl cellulose, carboxymethyl cellulose, sodium polyacrylate, and sodium polymethacrylate; surfactants which include anionic surfactant such as sodium dodecylbenzene sulfonate, sodium octadecyl sulfate, sodium oleate, sodium laurate, and potassium stearate, cationic surfactant such as lauryl amine acetate, stearyl amine acetate, and lauryl trimethyl ammonium chloride, amphoteric surfactant such as lauryl dimethyl amine oxide, nonionic surfactant such as polyoxyethylene alkyl ether, polyoxyethylene alkyl phenyl ether, and polyoxyethylene alkylamine, and the like; inorganic salt such as tricalcium phosphate, aluminum hydroxide, calcium sulfate, calcium carbonate, and barium carbonate; and the like.

According to needs, for example as the solvent, there are mentioned: alcohols such as methanol, ethanol, propanol, and butanol; multivalent alcohols such as ethylene glycol, propylene glycol, diethylene glycol, and triethylene glycol; Cellosolves such as methyl Cellosolve and ethyl Cellosolve; ketones such as acetone, methylethylketone, and ethyl acetate; ethers such as tetrahydrofuran; hydrocarbons such as benzene, toluene and hexane; water; or the like. These can be used singly, or two or more thereof can be mixed and used. With respect to 100 weight parts as a total amount of the unsaturated crystalline sulfonated polyester and other monomers added according to needs, a usage amount of the above-described solvent is preferably 50 to 5000 weight parts, more preferably 120 to 1000 weight parts. The colorant can also be mixed in before this emulsification process.

As an example of a preparation method of the resin particle dispersion by the phase-transfer emulsification method, for example, the following method is mentioned. Specifically, for example, the amorphous polyester resin is dissolved into a mixed solution of an organic solvent (good solvent) and a water-soluble solvent (water-soluble poor solvent), a corrective (for example, ammonia and the like) and a dispersion stabilizer are added thereto according to needs, a water-soluble solvent (for example, water) is dropped thereinto under agitation, and emulsified particles are obtained, and thereafter, the solvent in the resin particle dispersion is removed, whereby an emulsion liquid is obtained. Note that an order of pouring the corrective and the dispersion stabilizer may be changed.

As the organic solvent for use in this phase-transfer emulsification, for example, there can be illustrated: alcohols such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol, and cyclohexanol; ketones such as methylethylketone, methylisobutylketone, ethylbutylketone, cyclohexanone, and isophorone; ethers such as tetrahydrofuran, dimethyl ether, diethyl ether, and dioxane; esters such as methyl acetate, ethyl acetate, n-propyl acetate, isopropyl acetate, n-butyl acetate, isobutyl acetate, sec-butyl acetate, 3-methoxybutyl acetate, methyl propionate, ethyl propionate, butyl propionate, dimethyl oxalate, diethyl oxalate, dimethyl succinate, diethyl succinate, diethyl carbonate, and dimethyl carbonate; glycol derivatives such as ethylene glycol, ethylene glycol monomethyl ether, ethylene glycol monoethyl ether, ethylene glycol monopropyl ether, ethylene glycol monobutyl ether, ethylene glycol ethyl ether acetate, diethylene glycol, diethylene glycol monomethyl ether, diethylene glycol monoethyl ether, diethylene glycol monopropyl ether, diethylene glycol monobutyl ether, diethylene glycol ethyl ether acetate, propylene glycol, propylene glycol monomethyl ether, propylene glycol monopropyl ether, propylene glycol monobutyl ether, propylene glycol methyl ether acetate, and dipropylene glycol monobutyl ether; and further, 3-methoxy-3-methylbutanol; 3-methoxybutanol; acetonitrile; dimethylformamide; dimethylacetoamide; diacetone alcohol; ethyl acetoacetate; and the like. These solvents may be used singly, or two or more thereof may be used in combination.

A solvent amount for obtaining a desired dispersion particle diameter differs depending on physical properties of resin, and accordingly, it is difficult to uniquely determine a solvent amount of the organic solvent for use in the phase-transfer emulsification. However, in the present invention, a content of a tin compound catalyst in the resin is large with respect to the usual polyester resin, and accordingly, it is preferable that the solvent amount with respect to the resin mass be relatively large. In the case where the solvent amount is small, emulsifiability becomes insufficient, and in some case, there occur a diameter increase of the particle diameter of the resin particles, broadening of the particle size distribution, and the like.

Here, a description is made of the phase-transfer emulsification. The emulsification is identified into three types, which are natural emulsification, phase-transfer emulsification, and forcible emulsification. An emulsion liquid obtained by the emulsification is an emulsion. An emulsion, in which a dispersoid is oil, and a dispersion medium is water, is referred to as an O/W type, and an emulsion, in which a dispersoid is water, and a dispersion medium is oil, is referred to as a W/O type. The emulsion adopts either configuration of an oil-in-water (O/W-type) emulsion, in which oil droplets are dispersed in water, and a water-in-oil (W/O-type) emulsion. In the present invention, the water-in-oil (W/O-type) emulsion is once formed, and the aqueous medium is then increased, and so on, whereby the water-in-oil (W/O-type) emulsion is transferred to the oil-in-water (O/W-type) emulsion. Such a transfer phenomenon and operations therefor are referred to as the phase-transfer emulsification.

In the case of dispersing the binder resin in water, it is preferable to neutralize, by the corrective, a part or all of the carboxyl radicals in the resin according to needs. As the corrective, for example, there are mentioned: inorganic alkaline such as potassium hydroxide and sodium hydroxide; amines such as ammonia, monomethylamine, dimethylamine, triethylamine, monoethylamine, diethylamine, triethylamine, mono-n-propylamine, dimethyl-n-propylamine, monoethanolamine, diethanolamine, triethanolamine, N-methylethanolamine, N-aminoethylethanolamine, N-methyldiethanolamine, monoisopropanolamine, diisopropanolamine, triisopropanolamine, N,N-dimethylpropanolamine; and the like, and one or two or more selected from these can be used. By adding these correctives, pH at the time of emulsification can be adjusted at the vicinity of neutrality, and hydrolysis of the obtained polyester resin dispersion can be prevented.

Moreover, also at this time of phase-transfer emulsification, a dispersant may be added for the purpose of stabilizing the dispersion particles and preventing the viscosity increase of the aqueous medium. As the dispersant concerned, for example, there are mentioned: a water-soluble polymer such as polyvinyl alcohol, methyl cellulose, ethyl cellulose, hydroxyethyl cellulose, carboxymethyl cellulose, sodium polyacrylate, and sodium polymethacrylate; surfactants which include anionic surfactant such as sodium dodecylbenzene sulfonate, sodium octadecyl sulfate, sodium oleate, sodium laurate, and potassium stearate, cationic surfactant such as lauryl amine acetate, stearyl amine acetate, and lauryl trimethyl ammonium chloride, amphoteric surfactant such as lauryl dimethyl amine oxide, nonionic surfactant such as polyoxyethylene alkyl ether, polyoxyethylene alkyl phenyl ether, and polyoxyethylene alkyl amine, and the like; an inorganic compound such as tricalcium phosphate, aluminum hydroxide, calcium sulfate, calcium carbonate, and barium carbonate; and the like. These dispersants may be used singly, or two or more thereof may be used in combination. It is preferable that the dispersant be added by 0.01 mass % or more to 20 mass % or less with respect to 100 mass % of the binder resin.

It is desirable that an emulsification temperature at the time of phase-transfer emulsification be equal to or less than a boiling point of the organic solvent and equal to or more than a melting point or glass transition point of the binder resin. If the emulsification temperature is less than the melting point or glass transition point of the binder resin, then it becomes difficult to prepare the binder particle dispersion. Note that, in the case of performing the emulsification at the boiling point of the organic solvent or more, the emulsification just needs to be performed in a device that is pressurized and hermetically sealed.

In usual, a content of the resin particles contained in the resin particle dispersion is preferably 5 mass % or more to 50 mass % or less, more preferably, 10 mass or more to 40 mass % or less. If the content is out of the above-described range, then in some case, the particle size distribution of the resin particles is broadened, and the characteristics are deteriorated.

(C) Solvent Removal/Dispersion Preparation Process

This process is a process of removing the above-described organic solvent in the binder resin solution droplets, and preparing the resin particle dispersion. At this time, removal of 99% or more of the organic solvent facilitates control of a core-shell structure at the time of forming the toner.

As a method of removing the organic solvent, preferably used are a method of volatilizing the organic solvent from the emulsion liquid at 15° C. to 70° C., and a method in which pressure reduction is combined with such a volatilization method.

(D) Aggregation Process

This process is a process of forming toner particles by using: the resin particle dispersion (colored or non-colored resin particles) obtained by the above-described dispersion preparation process; the colorant dispersion obtained by the above-described (2) colorant dispersion preparation process; and the crystalline polyester resin dispersion obtained by the above-described (4) crystalline polyester preparation process. Moreover, in the aggregation process concerned, together with the resin particles and the colorant particles, releasing agent particles obtained by the above-described (3) releasing agent dispersion preparation process, intercalating agent particles such as charge control agent particles, and the like can also be added and aggregated.

A preferable aggregation method is a method of performing the aggregation in such a manner that a salting agent made of alkaline metal salt, alkaline earth metal salt or the like is added as an aggregation agent, which has a concentration equal to or more than a critical aggregation concentration, into water where the resin particles and the colorant particles are present, and subsequently, a resultant solution is heated to a temperature that is a glass transition point of the resin particles or more and a melting peak temperature (° C.) of the releasing agent or more. Moreover, for the resin particles, plural types are used in combination, and (1) the aggregation agent is added under the presence of all of the resin particles, followed by heating, whereby the aggregation may be performed, or (ii) the aggregation agent is first added under the presence of a part of the resin particles, followed by heating, whereby the aggregation is started, and thereafter, for coating the aggregated aggregation particles, the rest of the resin particles (coating resin particle dispersion) are added, and the aggregation may be further performed. In the case where the rest of the resin particles are added after the aggregation is once started, and the aggregation is further performed, then circularity SD can be controlled by timing of adding the resin particles to be added later. That is to say, as such addition timing of the resin particles to be added later is earlier, the circularity SD can be made smaller, and as the addition timing is slower, the circularity SD can be made larger.

For example, in terms of the median diameter in the volume basis, the particle diameter of the toner is preferably 4 to 8 μm, more preferably 6 to 8 μm. By the fact that the particle diameter of the toner is within the above-described range, transfer efficiency is increased, image quality of a half tone is enhanced, and image quality of a fine line, a dot and the like is enhanced.

A melting temperature (Tm) of the crystalline polyester resin for use in this embodiment is desirably within a range of 25° C. or more to 50° C. or less, more suitably within a range of 25° C. or more to 45° C. or less.

Note that the melting point of the above-described crystalline polyester resin is obtained as a peak temperature of the endothermic peak obtained by the above-mentioned differential scanning calorimetry (DSC).

A content of the crystalline polyester resin in the toner is desirably within a range of 1 mass % or more to 40 mass or less, more desirably within a range of 5 mass % or more to 20 mass % or less. If the content of the crystalline polyester resin is less than 1 mass %, then in some case, sufficient low-temperature fixing property is not obtained. Meanwhile, if the content exceeds 40 mass %, then there occurs toner flattening or the like owing to softness inherent in the crystalline resin, and in an image forming system that uses a photosensitive film, a charge roll and a transfer roll, an image quality defect becomes prone to occur owing to contamination of these members in some case.

(E) Aging Process

A method is preferable, in which this process is performed by heat energy (being heated). Specifically, a liquid containing associated particles is heated and agitated, whereby a shape of the associated particles is adjusted by a heating temperature, an agitation rate and a heating time until reaching desired circularity, and toner base particles are obtained.

(F) Cooling Process

This process is a process of performing cooling treatment (rapid cooling treatment) for a dispersion of the above-described toner base. With regard to cooling treatment conditions, the dispersion is cooled at a cooling rate of 1 to 20° C./min.

A cooling treatment method is not particularly limited, and there can be illustrated a cooling method by introducing a refrigerant from an outside of a reaction container, and a cooling method by directly pouring cold water into a reaction system.

(G) Solid-Liquid Separation/Cleaning Process

In this solid-liquid separation/cleaning process, there are implemented: solid-liquid separation treatment of performing solid-liquid separation for the colored particles, which are cooled to a predetermined temperature by the above-described process, from the dispersion of the colored particles concerned; and cleaning treatment of removing attached matter such as the surfactant and the salting agent from solid-liquid-separated toner cake (aggregate obtained by aggregating, into a cake shape, the colored particles in a wet state). Here, as a filtration treatment method, there are mentioned a centrifugal separation method, a reduced-pressure filtration method using Nutsche or the like, a filtration method performed by using a filter press and the like, and the like; however, the filtration treatment method is not particularly limited to these.

(H) Drying Process

This process is a process of performing drying treatment for the cake subjected to the cleaning treatment, and obtaining colored particles which are dried. As a dryer for use in this process, a spray dryer, a vacuum freezing dryer, a reduced-pressure dryer and the like can be mentioned, and it is preferable to use a stationary shelf dryer, a moving shelf dryer, a fluidized-bed dryer, a rotary dryer, an agitation dryer and the like.

Moisture in the colored particles thus dried is preferably 5 mass % or less, more preferably 2 mass % or less. Note that, in the case where the colored particles subjected to the drying treatment are aggregated by weak inter-particle gravity, such an aggregate thereof may be subjected to disintegrating treatment. Here, as a disintegrating treatment device, a mechanical disintegrating device such as a jet mill, a Henschel mixer, a coffee mill, and a food processor can be used.

(I) External Additive Treatment Process

This process is a process of mixing an external additive to the dried colored particles according to needs, and preparing the toner. As a mixing device of the external device, a mechanical mixing device such as Henschel mixer and a coffee mill can be used.

[Preparation of Developer]

With regard to the toner of the present invention, for example, there are considered: a case of containing a magnetic material therein, and using the toner concerned as one-component magnetic toner; a case of mixing the toner concerned with a so-called carrier, and using the toner as a two-component developer; a case of singly using such non-magnetic toner concerned; and the like, and the toner can be suitably used in any of the cases.

In the toner of the present invention, in the case of using the toner as the two-component developer with which the carrier is mixed, an occurrence of toner filming (carrier contamination) to the carrier can be suppressed, and in the case of using the toner as the one-component developer, an occurrence of the toner filming to a triboelectrification member of a developing device can be suppressed.

As the carrier that composes the two-component developer, there can be used magnetic particles made of a material heretofore known in public, which includes metal such as iron, ferrite and magnetite, an alloy of the metal and metal such as aluminum and lead, and the like, and in particular, it is preferable to use ferrite particles.

With regard to the carrier, a volume average particle diameter is preferably 15 to 100 μm, more preferably 25 to 60 μm. Representatively, the volume average particle diameter of the carrier can be measured by a laser diffraction particle size distribution measuring device "HELOS" (made by SYMPATEC GmbH), which includes a wet disperser.

As the carrier, it is preferable to use one further coated with resin, or a so-called resin dispersion carrier in which magnetic particles are dispersed into resin. A composition of the resin for coating the carrier is not particularly limited; however, for example, olefin resin, styrene resin, styrene-acrylic resin, silicon resin, ester resin or fluorine-containing polymer resin, and the like are used Moreover, the resin for composing the resin dispersion carrier is not particularly limited, and those known in public can be used. For example, styrene-acrylic resin, polyester resin, fluorine resin, phenol resin and the like can be used.

[Image Forming Method]

The toner described above can be suitably used for an image forming method including a fixing process according to a contact heating mode. In the image forming method, specifically, the toner as described above is used, and for example, an electrostatic latent image electrostatically formed on an image carrier is allowed to emerge in such a manner that the developer is electrified by the triboelectrification member in the developing device. In such a way, a toner image is obtained. Then, this toner image is transferred to a sheet, and thereafter, the toner image transferred onto the sheet is fixed to the sheet by fixing treatment according to the contact heating mode, whereby a visible image is obtained.

[Fixing Method]

As a suitable fixing method for use in the toner of the present invention, a method according to the so-called contact heating mode can be mentioned. As the contact heating mode, in particular, there can be mentioned a hot-press fixing mode, and further, a heat roll fixing mode, and a press-contact heating fixing mode of fixing the image by a rotating pressure member that contains therein a fixedly arranged heating body.

In the fixing method according to the heat roll fixing mode, in usual, a fixing device is used, which is composed of an upper roller provided with a heat source in an inside of a metal cylinder made of iron, aluminum or the like, the metal cylinder having fluorine resin or the like coated on a surface thereof, and of a lower roller formed of silicon rubber or the like.

As the heat source, a linear heater is used. By the heater, a surface temperature of the upper roller is raised to an approximate range of 120 to 200° C. A pressure is applied between the upper roller and the lower roller, and the lower roller is deformed by this pressure, whereby a so-called nip is formed in such a deformed portion. A width of the nip is set at 1 to 10 mm, preferably 1.5 to 7 mm. Preferably, fixing linear velocity is set at 40 mm/sec to 600 mm/sec. If the width of the nip is too small, then it becomes impossible to uniformly impart heat to the toner, and fixing unevenness sometimes occurs. Meanwhile, if the width of the nip is too large, then the melting of the polyester resin contained in the toner particles is accelerated, and fixing offset occurs in some case.

EXAMPLES

I. Preparation of Variety of Raw Material Dispersions (Preparation of Ultrahigh Molecular Weight Styrene Resin (1))

<<First-Stage Polymerization>>

An agitation device, a temperature sensor, a cooling pipe and a nitrogen introduction device were attached to a 5 L reaction container, such a device was charged with a surfactant solution in advance, and a liquid temperature was raised to 80° C. while agitating the solution at a rotation speed of 230 rpm under a flow of nitrogen. For the surfactant solution, there were used 2.0 parts of anionic surfactant (sodium dodecylbenzene sulfonate: SDS) and 2900 parts of ion exchange water.

9.0 parts of a polymerization initiator (potassium persulfate: KPS) and 60 parts of itaconic acid were added to the surfactant solution, and thereafter, a monomer solution composed of 1958 parts of n-butylacrylate and 945 parts of methyl methacrylate was dropped to a resultant solution. After the droppage of the monomer solution was ended, a resultant was held at 78° C. for 1 hour.

<<Second-Stage Polymerization>>: Formation of Outer Layer 2 parts of anionic surfactant (sodium polyoxy (2) dodecyl ether sulfonate) was dissolved into 1100 parts of ion exchange water, and a surfactant solution was prepared. Moreover, in a flask attached with an agitation device, a monomer composition composed of 202 parts of styrene, 105 parts of N-butylacrylate, 22 parts of methacrylic acid and 5 parts of N-octyl mercaptan was heated to 85° C., and a monomer solution [1] was prepared.

To the surfactant solution heated to 90° C., there were added 28 parts of the above-described resin fine particle dispersion (A1) and the monomer solution [1]. Then, an obtained resultant was mixed/dispersed for 4 hours by a mechanical disperser"Clearmix" (made by M Technique Co., Ltd.) having a circulation route, and a dispersion was prepared.

An agitation device, a temperature sensor, a cooling pipe and a nitrogen introduction device were attached to a 5 L reaction container, such a device was charged with the obtained solution, and the solution was heated for 1 hour at a liquid temperature of 85° C. while being agitated at a rotation speed of 10 rpm under a flow of nitrogen. Thereafter, the agitation speed was raised to 230 rpm, then an aqueous initiator solution in which 11 parts of a polymerization initiator (KPS) was dissolved into 211 parts of ion exchange water was added to the dispersion, and a mixed solution was heated/agitated at 85° C. for 2 hours. Thereafter, the solution was further heated/agitated at 90° C. The dispersion obtained in this second-stage polymerization is defined as a (resin fine particle dispersion A).

(Preparation of Amorphous Polyester Resin (1))

Bisphenol A propylene oxide 2 mol adduct 310 parts
Terephthalic acid 116 parts
Fumaric acid 12 parts
Dodecenyl succinic acid 54 parts
Ti(OBu) 40.05 parts The above-described raw materials were poured into a heated and dried three-neck flask, air in such a container was thereafter reduced in pressure by a pressure reducing operation, further, the inside of the container was set at an inert atmosphere by nitrogen gas, and the raw materials were circulated at 180° C. for 5 hours by mechanical agitation. Thereafter, while evaporating water, which was generated in the reaction system, by reduced-pressure evaporation, a temperature of an obtained mixture was gradually raised to 240° C. Moreover, a dehydration/condensation reaction was continued at 240° C. for 3 hours, and when a thick state came, molecular weight of the mixture was confirmed by the GPC. When a weight-average molecular weight of the mixture reached 27000, the reduced-pressure evaporation was stopped, and amorphous polyester resin (1) was obtained. The amorphous polyester resin (1) was amorphous, in which a glass transition point was 63° C., and an acid value was 14 mgKOH/g. Note that, in the present invention, "Bu" refers to "butyl".

(Preparation of Crystalline Polyester Resin Dispersion (1))

230 parts of 1,10-dodecanedioic acid, 160 parts of 1,9-nonanediol, and 0.2 part of dibutyl tin oxide as a catalyst were poured into a three-neck flask. Thereafter, by a pressure reducing operation, nitrogen was substituted for air in the three-neck flask, and an inside of the flask was set at an inert atmosphere. Then, these materials were mechanically agitated at 180° C. for 5 hours, and were circulated, whereby a reaction thereamong was progressed. During the reaction, water generated in such a reaction system was evaporated. Thereafter, a temperature of an obtained mixture was gradually raised to 230° C. under the reduced pressure, and the mixture was agitated for 2 hours. When a thick state came, a molecular weight of the mixture was confirmed by GPC. When a weight-average molecular weight of the mixture reached 27000, the reduced-pressure evaporation was stopped, and crystalline polyester resin was obtained.

Subsequently, 100 parts of the crystalline polyester resin thus obtained, 35 parts of ethyl acetate and 35 parts of isopropyl alcohol were poured into a separable flask, these were sufficiently mixed and dissolved at 75° C., and thereafter, 5.5 parts of a 10% aqueous ammonia solution was dropped thereinto. Such a heating temperature was lowered to 60° C., and while agitating a resultant solution, ion exchange water was dropped thereinto at a liquid feed speed of 6 g/min by using a liquid feed pump. After the solution became whitish, the liquid feed speed was raised to 25 g/min, and when a total amount of the fed solution reached 400 parts, the droppage of the ion exchange water was stopped. Thereafter, the solvent was removed under the reduced pressure, and a crystalline polyester resin dispersion (1) was obtained. A volume average particle diameter of the crystalline polyester resin particles thus obtained was 140 nm, and a solid content concentration of the polyester resin particles concerned was 170.

(Preparation of Cyan Colorant Dispersion)

Copper phthalocyanine compound C.I. Pigment Blue 15: 3 (made by Clariant International Limited) 50 parts
Ionic surfactant Neogen RK (made by Dai-ichi Kogyo Seiyaku Co., Ltd.) 5 parts
Deionized water 195 parts The above-described materials were mixed and dissolved together, and were dispersed for 10 minutes by a homogenizer (Ultra-Turrax made by IKA Japan K. K.), whereby a cyan colorant dispersion was obtained, in which a medium particle diameter was 185 nm, and a solid content amount was 20 mass %.

(Preparation of Releasing Agent Dispersion)

Paraffin wax FNP 92 (melting point: 91° C., made by Nippon Seiro Co., Ltd.) 50 parts
Neogen RK (made by Dai-ichi Kogyo Seiyaku Co., Ltd.) 5 parts
Ion exchange water 195 parts The above-described materials were heated to 60° C., were sufficiently dispersed by Ultra-Turrax T50 made by IKA Japan K.K., and were thereafter subjected to dispersion treatment by a pressure ejection Gaulin homogenizer, whereby a wax dispersion was obtained, in which a medium diameter was 170 nm, and a solid content amount was 20 mass %.

II. Preparation of Toner (Preparation of Toner (1))

(A) Binder Resin Solution Preparation Process 29.6 parts (in conversion to solid content) of the above-described amorphous polyester resin (1) and 4.3 parts (in conversion to solid content) of the resin fine particle dispersion A as the ultrahigh molecular weight styrene resin (1) and 50 parts of ethyl acetate were sufficiently mixed and dissolved at 65° C.

(B) Resin Solution Dispersion Process

A solution obtained by the above-described (A) process, 2 parts of 20% anionic surfactant (dowfax2Al, 20% aqueous solution) and 5 parts of a 10% aqueous ammonia solution were poured into a separable flask. Thereafter, while heating and agitating a resultant solution at 40° C., ion exchange water was dropped thereinto at a liquid feed speed of 8 g/min by using a liquid feed pump. After the solution became whitish, the liquid feed speed was raised to 25 g/min to transfer the phase, and when an amount of the fed liquid reached 135 parts, the droppage of the ion exchange water was stopped, and the solution was dispersed as binder resin solution droplets.

(C) Solvent Removal/Dispersion Preparation Process

Thereafter, the removal of the solvent was performed by a rotary evaporator, and an amorphous polyester resin particle dispersion (1) was obtained. A volume-average particle diameter of the obtained polyester resin particles was 132 nm, and a solid content concentration of the polyester resin particles was 34%.

(D) Aggregation Process

Into a polymerization furnace provided with a pH meter, an impeller and a thermometer, there were poured, among the above-described raw materials: 240 parts (in conversion to solid content) of the amorphous polyester resin dispersion (1); 61 parts (in conversion to solid content) of the crystalline polyester resin particle dispersion (1); 32 parts of the anionic surfactant (dowfax2A1, 20% aqueous solution); and 1278 parts of the ion exchange water. While agitating these at 200 rpm for 15 minutes, the surfactant was given affinity with the amorphous polyester resin particle dispersion (1). Such a resultant was further agitated, sufficient affinity was given thereto, and thereafter, 120 parts of the colorant dispersion (1) and 200 parts of the releasing agent dispersion (1) were added thereto and mixed therewith. Thereafter, a 0.3 M aqueous nitric acid solution was added to this raw material mixture, and pH thereof was adjusted at 2.7. Subsequently, while applying shearing force to the raw material mixture at 1000 rpm by Ultra-Turrax (made by IKA Japan K. K.), 250 parts of a 10% aqueous aluminum sulfate solution was dropped thereinto as an aggregation agent. Note that, since viscosity of the raw material mixture was increased during a period while the aggregation agent was being dropped, a dropping speed was slowed down at the point of time when the viscosity was increased, so that attention was paid so as not to bias the aggregation agent to a single spot. After the droppage of the aggregation agent was ended, the number of revolutions was further raised to 6000 rpm to agitate such a mixture concerned for 5 minutes. In such a way, the aggregation agent and the raw material mixture were sufficiently mixed with each other.

Subsequently, while heating the above-described raw material mixture at 30° C. by a mantle heater, the raw material mixture concerned was agitated at 550 to 650 rpm. After the agitation for 60 minutes, it was confirmed that particles were formed stably at a primary particle diameter by using Multi-Sizer Type III (aperture diameter: 50 μm, made by Beckmann Coulter Co., Ltd.). Thereafter, a temperature of the raw material mixture was raised to 45° C. at a rate of 0.5° C./min in order to grow the aggregation particles. The growth of the aggregation particles was confirmed at any time by using the Multi-Sizer Type III, and the aggregation temperature and the number of revolutions in agitation were changed depending on an aggregation rate of the aggregation particles. Meanwhile, for the purpose of coating the aggregation particles, to 411 parts of the amorphous polyester resin dispersion (1), there were added and mixed 145 parts of ion exchange water and 15% of the anionic surfactant (dowfax2A1, 20% aqueous solution), and a coating resin particle dispersion (1) that was adjusted to pH 2.7 in advance was prepared. At the point of time when the aggregation particles were grown to 5.0 μm in the above-described aggregation process, the above-described coating resin particle dispersion (1) was added thereto, and a resultant was held for 10 minutes while being agitated.

Thereafter, in order to stop the growth of the coated aggregation particles (adhesion particles), 33 parts of an aqueous EDTA solution (aqueous solution obtained by diluting Chelest 40 made by Chelest Corporation to a 12% concentration by ion exchange water) and a 1 M aqueous sodium hydroxide solution were added in this order, and pH of the raw material mixture was controlled to 7.5, and the aggregation process was completed.

(E) Aging Process, (F) Cooling Process

Subsequently, in order to fuse and age the aggregation particles, the temperature of the raw material mixture was raised to 85° C. at a temperature rise rate of 1° C./min while adjusting pH thereof to 6.5. The fusing among the particles was progressed until desired circularly was achieved by measurement using FPIA-2100. After confirming the fusion among the particles, such a solution was cooled to 30° C., and the agitation was stopped.

(G) Solid-Liquid Separation/Cleaning Process, (H) Drying Process

Subsequently, with regard to the obtained particles, pH of cooled slurry thereof was adjusted to 9.0 by a 1 N aqueous sodium hydroxide solution, and a resultant solution was agitated for 20 minutes, and was once sieved by a mesh of 20 μm. Thereafter, to a solid content, hot water (50° C.) of which amount was approximately ten times the solid content was added, and the solution was agitated for 20 minutes while adjusting pH thereof to 9.0 one more time, whereby hot alkaline cleaning was performed, and filtration was once performed. Moreover, the solid content that remained on filter paper was dispersed into slurry, was cleaned repeatedly three times by hot water of 40° C., a 0.3 N aqueous nitric acid solution was further added to the slurry to adjust pH to 4.0, and at the same time, acid cleaning was performed therefor at 40° C. Subsequently, finally, agitation/cleaning was performed for the slurry by 40° C. hot water as ion exchange water, and further drying treatment was performed therefor at room temperature, whereby toner (1) with a volume-average particle diameter of 6.6 μm was obtained.

(Preparation of Toner (2))

In the (preparation of toner (1)), in place of adding the resin fine particles A at process A, a sample (1) (TSK standard polystyrene No. 05214 (Mw: 1.11 million) made by Tosoh Corporation)) dissolved into tetrahydrofuran (hereinafter, referred to as TI-IF) was dissolved into the amorphous polyester resin. Except for this, toner (2) was prepared in a similar way to the above.

(Preparation of Toner (3))

In the preparation of the ultrahigh molecular weight styrene resin (1) (resin fine particle A), the ultrahigh molecular weight styrene resin (1) was held at 85° C. for 30 minutes after the dispersion was poured in the second-stage polymerization. In a similar way to the above except for this, a resin fine particle dispersion B was prepared, and toner (3) was prepared in a similar way to the above on and after this preparation.

(Preparation of Toner (4))

In the preparation of the ultrahigh molecular weight styrene resin (1) (resin fine particle A), the ultrahigh molecular weight styrene resin (1) was held at 85° C. for 2 hours after the dispersion was poured in the second-stage polymerization. In a similar way to the above except for this, a resin fine particle dispersion C was prepared, and toner (4) was prepared in a similar way to the preparation of the toner (1) on and after this preparation.

(Preparation of Toner (5))

In the preparation of the ultrahigh molecular weight styrene resin (1) (resin fine particle A), the itaconic acid for use in the first-stage polymerization was changed to fumaric acid. In a similar way to the above except for this, a resin fine particle dispersion D was prepared, and toner (5) was prepared in a similar way to the preparation of the toner (1) on and after this preparation.

(Preparation of Toner (6))

In the (preparation of toner (1)), the amorphous polyester resin (1) dissolved in the process A was changed in parts to 25.5 parts, and the ultrahigh molecular weight styrene resin (1) dissolved in the process A was changed in parts to 8.5 parts. In a similar way to the above except for this, toner (6) was prepared.

(Preparation of Toner (7))

In the (preparation of toner (1)), the amorphous polyester resin (1) dissolved in the process A was changed in parts to 33.3 parts, and the ultrahigh molecular weight styrene resin (1) dissolved in the process A was changed in parts to 0.7 parts. In a similar way to the above except for this, toner (7) was prepared.

(Preparation of Toner (8))

In the (preparation of toner (1)), the amorphous polyester resin fine particle dispersion (1) dissolved in the process D was changed in parts to 287 parts, and the crystalline polyester resin particle dispersion (1) dissolved in the process D was changed in parts to 0. In a similar way to the above except for this, toner (8) was prepared.

(Preparation of Toner (9))

In the (preparation of toner (2)), in place of adding the sample (1), a sample (2) (TSK standard polystyrene No. 05217 (Mw: 4.27 million) made by Tosoh Corporation)) dissolved into THF was dissolved into the amorphous polyester resin. Except for this, toner (9) was prepared in a similar way to the above.

(Preparation of Toner (10))

In the (preparation of toner (1)), the polyester resin was dissolved without using the ultrahigh molecular weight styrene resin (1) (resin fine particle A). In a similar way to the above except for this, toner (10) was prepared.

(Preparation of Toner (11))

In the preparation of the ultrahigh molecular weight styrene resin (1) (resin fine particle A), the ultrahigh molecular weight styrene resin (1) was held at 85° C. for 15 minutes after the dispersion was poured in the second-stage polymerization. In a similar way to the above except for this, a resin fine particle dispersion E was prepared, and toner (11) was prepared in a similar way to the preparation of the toner (1) on and after this preparation.

(Preparation of Toner (12))

In the preparation of the toner (1), the coating resin fine particle dispersion (1) was not used. In a similar way to the above except for this, toner (12) was prepared.

To the toner particles (1) to (12) obtained as described above, as external additives, there were added silica fine powder (particle diameter: 50 nm) and titania fine powder (particle diameter: 40 nm) by 0.9 part and 0.6 part with respect to 100 parts of the toner base particles, respectively, followed by mixing by the Henschel mixer, whereby developers (1) to (11) were obtained.

III. Evaluation

The following evaluations were performed, and results thereof were shown in the attached Table 1.

(High-Temperature Offset Occurrence Temperature)

A commercially available copier printer "bizhub Pro C500" (made by Konica Minolta Business Technologies, Inc.) was used, in which, in a fixing device, a surface temperature of a heating roller was set changeable within a range of 120 to 210° C. At a normal temperature and a normal humidity (temperature: 20° C.; relative humidity: 55%), a fixing test of fixing a solid band image with a width of 5 mm, which was extended in a direction along the heating roller, was repeatedly performed while changing a set fixing temperature so that the fixing temperature could be increased by every 5° C. from 120° C. Subsequently, a fixed image thus obtained was rubbed ten times by bleached cloth with a pressure of 1 Pa, reflection densities before and after the rubbing were measured, and from a difference therebetween, a fixing rate was measured in accordance with the following expression.

$$\text{Fixing rate}=(\text{reflection image density after rubbing})/(\text{reflection image density before rubbing})\times 100\ (\%)$$

The surface temperature of the heating roller, at which the fixing rate reached 70% or more, was measured as a lowest fixing temperature, and a fixing temperature at the fixing test in which image dirt owing to the high-temperature offset was visually observed was measured as a high-temperature offset temperature. Results are shown in Table 1. Note that, in Table 1, "not occurred" stands for that the high-temperature offset did not occur up to 210° C. Those in which the high-temperature offset did not occur up to 185° C. are regarded as acceptable.

(Image Quality)

The sample No. 5-1 (color continuous tone portrait and color gradation batch) of "Test Chart No. 3, The Imaging Society of Japan" issued by the first work group of The Imaging Society of Japan was outputted, image evaluation was visually performed. Attention was paid to gradation scale portions and velvety appearances of middle tones of blue and cyan, evaluation was performed based on the following criteria, and those of "double circle (◎)" and "single circle (○)" were regarded as acceptable.

[Evaluation Criteria]

"Double circle (◎)": Granularity was not visually revealed at all. In addition, toner particles which might cause dust were not observed when a space between dots was observed under a loupe with a 20 power magnification.

"Single circle (○)": Slight granularity was visually revealed when being gazed. Alternatively, 1 to 3 toner particles which might cause the dust were confirmed when the space between the dots was observed under the loupe with a 20 power magnification.

"Cross (X)": Rough granularity was visually revealed in comparison with an image of "single circle as rank". Alternatively, an uncountably large number of the toner particles which might cause the dust were present when the space between the dots was observed under the loupe with a 20 power magnification.

(Separation Property)

The fixing device was changed so that the surface temperature of the heating roller thereof could be changed by every 10° C. within a range of 130° C. to 180° C. At each temperature, a solid black band image with a width of 5 cm was formed on A4-size POD gloss coat paper (made by Oji Paper Co., Ltd.) in a direction perpendicular to a conveying direction. Then, an actual printing test was performed, in which such printed matter (recording material) was conveyed in a longitudinal feeding manner. Separation property between the heating roller and the recording material was determined by the following evaluation criteria. Note that, if the evaluation criteria indicate "double circle (◎)", then the separation property was determined to be excellent, and if the evaluation criteria indicate "single circle (○)", then the separation property was determined to be good.

[Evaluation Criteria]

"Double circle (◎)": Recording material is separated from heating roller without being curled.

"Single circle (○)": Though recording material is separated from heating roller by separation hook, track of separation hook is hardly conspicuous on image.

"Cross (X)": Recoding material separates from heating roller by separation hook, and track of separation hook remains on image. Alternatively, wind adhesion of recording material to heating roller occurs, and recording material cannot be separated from heating roller.

Note that, in Table 1, there were shown particle diameters $D_{50}$ (nm), weight-average molecular weights (Mw), number-average molecular weights (Mn) and blend ratios of the resin fine particles, and peak top molecular weights (Mp) and area ratios (%) of the ultrahigh molecular weight equivalent portions. Here, the blend ratio refers to a charging mass ratio (mass %) of the ultrahigh molecular weight styrene resin in the binder resin of the toner.

From results of Table 1, it is understood that, with regard to the toners 1 to 8 and 12, the high-temperature offset temperature is as high as 190° C. or more, and these toners are superior to the toners 9 to 11 also in image quality and separation property.

In accordance with the present invention, to polyester resin, there is added ultrahigh molecular weight styrene resin in which a peak of a molecular weight distribution is in a range larger than 500 thousands and smaller than 3 million, whereby it becomes possible to suppress hot offset while enhancing productivity.

Moreover, the ultrahigh molecular weight styrene resin and the polyester resin are dissolved in the same solvent, and accordingly, the ultrahigh molecular weight styrene resin can be fused with the polyester resin at the molecular level by a simple operation, and an advantage in terms of the productivity is also brought.

What is claimed is:

1. A manufacturing method of toner which includes at least polyester resin and colorant, comprising the steps of:

(A) dissolving, into an organic solvent, the polyester resin and ultrahigh molecular weight styrene resin in which a peak is present in a range larger than 500 thousands and smaller than 3 million in a molecular weight distribution, and preparing a binder resin solution;

(B) dispersing the binder resin solution as binder resin solution droplets into an aqueous medium;

(C) removing the organic solvent from the binder resin solution droplets, and preparing a resin particle dispersion; and (D) aggregating resin particles from which the organic solvent is removed and colorant particles containing the colorant with each other, and forming toner particles.

2. The manufacturing method of toner according to claim 1, wherein, in the ultrahigh molecular weight styrene resin, the peak is present in a range larger than 1 million and smaller than 3 million in the molecular weight distribution.

3. The manufacturing method of toner according to claim 1, wherein the ultrahigh molecular weight styrene resin is present by 2 to 25% in binder resin of the toner.

4. The manufacturing method of toner according to claim 1, wherein the ultrahigh molecular weight styrene resin is produced by emulsion polymerization.

5. The manufacturing method of toner according to claim 4, wherein performing the emulsion polymerization at least includes a first-stage polymerization step and a second-stage polymerization step.

6. The manufacturing method of toner according to claim 4, wherein fine particles of the ultrahigh molecular weight styrene resin are subjected to the emulsion polymerization so as to have a median diameter of 50 to 300 μm in a volume basis.

7. The manufacturing method of toner according to claim 1, wherein the ultrahigh molecular weight styrene resin is a copolymer with a radical polymerizable divalent carboxylic acid monomer.

8. The manufacturing method of toner according to claim 1, wherein, in the step (D), the resin particles from which the organic solvent is removed, the colorant particles including the colorant, and crystalline polyester resin particles are aggregated with one another, and the toner particles are formed.

9. The manufacturing method of toner according to claim 1, wherein, in the step (D), the resin particles from which the organic solvent is removed and the colorant particles including the colorant are aggregated with each other, followed by adding a coating resin particle dispersion to aggregated particles in which the resin particles and the colorant particles are aggregated with each other, and the aggregated particles are coated with coating resin particles.

10. The manufacturing method of toner according to claim 1, wherein the polyester resin for use in the step (A) is linear polyester that does not include a trivalent or more carboxylic acid monomer.

11. The manufacturing method of toner according to claim 1, wherein a weight-average molecular weight (Mw) of the polyester resin for use in the step (A) ranges from 13000 to 50000.

* * * * *